United States Patent [19]

Chao et al.

[11] 3,972,114

[45] Aug. 3, 1976

[54] SELF-CLEANING MECHANISM FOR TWIN BLADE RAZORS

[76] Inventors: Albert Chao, Northvale, N.J.; Frank Fantigrossi, Medford, N.Y.

[22] Filed: Mar. 12, 1975

[21] Appl. No.: 551,040

[52] U.S. Cl. ..... 30/41; 30/50

[51] Int. Cl.[2] ..... B26B 21/22; B26B 21/40

[58] Field of Search ..... 30/41, 47, 50, 62, 63, 30/346.58

[56] References Cited

UNITED STATES PATENTS

| | | | |
|---|---|---|---|
| 2,093,762 | 9/1937 | Kroner | 30/41 |
| 2,141,086 | 12/1938 | Hotson | 30/41 |
| 2,715,267 | 8/1955 | Force | 30/50 |
| 3,783,510 | 1/1974 | Dawidowicz | 30/47 |

FOREIGN PATENTS OR APPLICATIONS

| | | | |
|---|---|---|---|
| 465,820 | 8/1935 | United Kingdom | 30/41 |

*Primary Examiner*—Al Lawrence Smith
*Assistant Examiner*—Gary L. Smith

[57] ABSTRACT

A self-cleaning mechanism arranged between the blades of a twin blade razor, whereby after use, the area between the blades which fill with human hair and soap, can be made clean and free of debris by the movement of the cleaning mechanism with a persons fingers.

6 Claims, 6 Drawing Figures

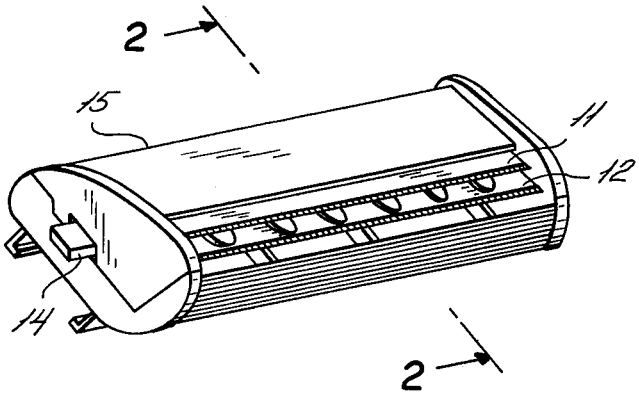
FIG. 1
FIG. 2
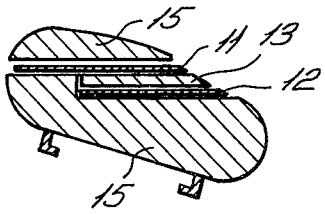
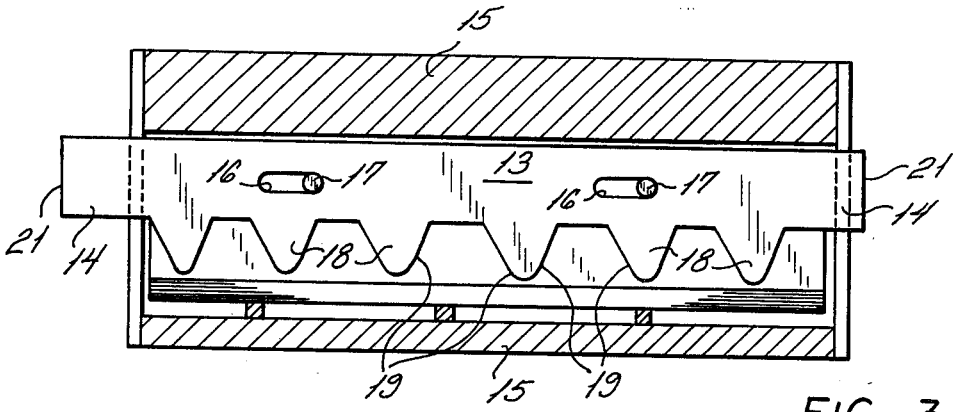
FIG. 3
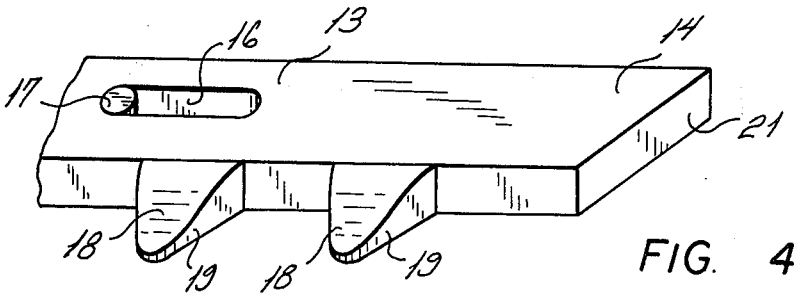
FIG. 4

SELF-CLEANING MECHANISM FOR TWIN BLADE RAZORS

This invention relates generally to twin blade razors.

A principle object of the present invention is to provide a twin blade razor with a self-cleaning mechanism to facilitate cleaning the area between the blades after use.

Another object is to provide a twin blade razor with a self-cleaning mechanism so that the razor may be kept clean to prolong the life of the razor.

Yet another object of this invention is to provide a self-cleaning mechanism between blades of a twin razor whereby subsequent use of the blade will be safer because the blades are free from debris and will not require additional force to shave and therefore will feel more comfortable.

Further objects of this invention will appear as the description proceeds.

To the accomplishment of the above and related objects this invention may be embodied in the form illustrated in the accompanying drawings, attention being called to the fact, however, that the drawings are illustrative only, and that changes may be made in the specific construction illustrated and described within the scope of the appended claims.

FIG. 1 is a perspective view of a twin blade razor showing the incorporation of the invention.

FIG. 2 is a side view taken on line 2—2 of FIG. 1.

FIG. 3 is a cross section showing the mechanism detail.

FIG. 4 is a cross section showing the operation of the self-cleaning mechanism.

Figure 5:
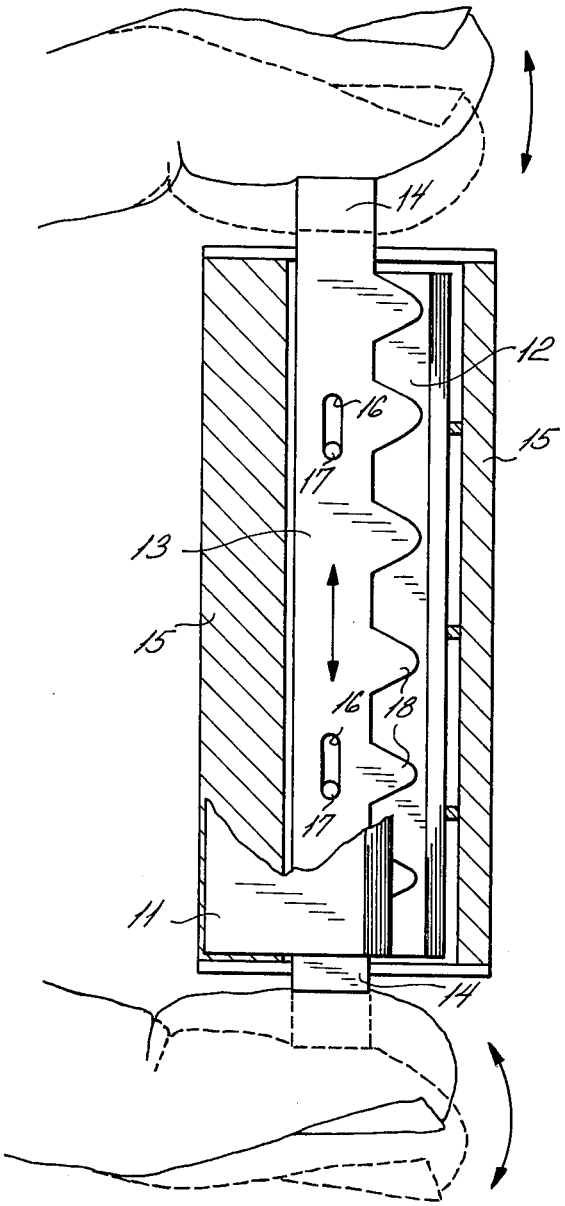
FIG. 5 is an enlarged detail of a portion of the self-cleaning mechanism.

Referring now to the drawings in detail and more particularly to FIGS. 1 to 6 thereof at this time. The upper blade 11 is separated from the lower blade 12 by a self-cleaning mechanism 13 with end protrusions 14.

Numeral 15 represents the plastic case common to some present cartridge type twin razor blades.

The self-cleaning mechanism 13 is between blades 11 and 12 and has slots 16 which allow the self-cleaning mechanism 13 to slide back and forth against posts 17.

In use, after shaving, debris such as human hair and soap generally are collected between the blades of twin blade razors. These debris generally can not be washed out easily. As a result the soap and hair dries and makes shaving difficult, unsafe, and uncomfortable when blade is used next.

In addition the cleaning mechanism 13 has a series of teeth 18 along the front edge. These teeth are made at an angle to the perpendicular of the direction of movement of the self-cleaning mechanism 13. This is so upon movement in the horizontal direction, the sides of the teeth 19 exert a force outward to help push out the debris to be washed away.

With this invention of the self-cleaning movable mechanism 13 installed between blades 11 and 12, after shaving, a person can grasp protrusions 14 of the self-cleaning mechanism 13 between his thumb and forefinger and while rinsing blades under hot water can apply a back and forth motion to mechanism 13 to loosen debris so water can rinse it away easily.

The posts 17 limit the movement of the self-cleaning mechanism depending on the length of slots 16.

Figure 6:
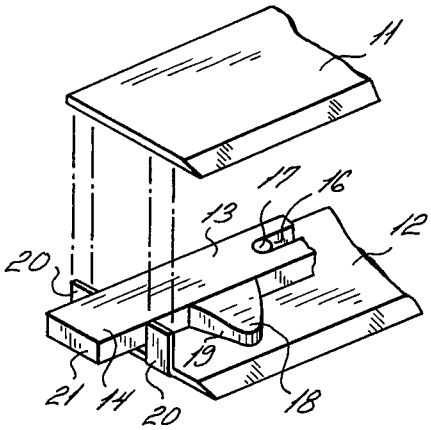
FIG. 6 is an explosion detail showing an injector twin blade incorporating the present invention.

The self-cleaning mechanism 13 can readily be installed on injector type twin blades as seen in FIG. 6. The operation is the same as described above. However, since normally blades in an injector system are clamped tightly together it may be necessary to have horizontal blade spacers 20. These spacers 20 made by bending upward the cut edge of the blade 12. This spacer 20 is slightly higher than the self-cleaning mechanism 13 to allow free and easy movement of the mechanism 13. In addition the range of movement of the mechanism 13 can be increased in the injector style blades so that upon installation of new blades the edge 21 of end protrusion 14 would be flush with the outside surface of the spacers 20 to aid in the removal and injection of old and new blades.

Thus a useful self-cleaning mechanism for twin blade razors is provided.

While certain novel features of this invention have been shown and described and are pointed out in the annexed claims, it will be understood that various omissions, substitutions and changes in the form and details of the device illustrated and in its operation can be made by those skilled in the art without departing from the spirit of the invention.

What is claimed is:

1. In a razor blade system comprising a blade case having a bottom support and a top cap, further comprising a pair of razor blades with cutting edges on the forward edges thereof and mounted between the support and the cap, the improvement comprising: a blade system cleaning mechanism; said cleaning mechanism being slidably mounted between said blades in said case; means connected to the cleaning mechanism to impart manual reciprocatory motion to the cleaning mechanism in a direction parallel to the blade edges.

2. The system of claim 1 wherein post means on the case are mounted to extend through slots in the cleaning mechanism and together guide the mechanism for reciprocation.

3. The system of claim 1 wherein laterally disposed limiting means are mounted on the case to limit the reciprocation of the cleaning mechanism.

4. The system of claim 1 wherein said cleaning mechanism has a front edge adjacent the blade edges and said front edge is comprised of a plurality of forwardly extending teeth.

5. The system of claim 1 wherein the reciprocating means includes two laterally extending protrusions.

6. The system of claim 1 wherein blade spacer means are formed from the bottom blade and extend upwardly to a position slightly higher than the top surface of the cleaning mechanism.

* * * * *